US005523202A

United States Patent [19]

Ohtani et al.

[11] Patent Number: 5,523,202

[45] Date of Patent: Jun. 4, 1996

[54] SILVER HALIDE EMULSION AND PROCESS FOR ITS PREPARATION

[75] Inventors: Hirofumi Ohtani; Sadayasu Ishikawa; Yoshikazu Ito, all of Hino, Japan

[73] Assignee: Konica Corporation, Tokyo, Japan

[21] Appl. No.: 413,239

[22] Filed: Mar. 30, 1995

[30] Foreign Application Priority Data

Apr. 8, 1994 [JP] Japan ..... 6-070855

[51] Int. Cl.[6] ..... G03C 1/005; G03C 1/34

[52] U.S. Cl. ..... 430/569; 430/567; 430/642; 430/615

[58] Field of Search ..... 430/567, 569, 430/642, 615

[56] References Cited

U.S. PATENT DOCUMENTS 5,015,563 5/1991 Ohya et al. ..... 430/569
5,286,621 2/1994 Verbeeck ..... 430/569

*Primary Examiner*—Mark F. Huff
*Attorney, Agent, or Firm*—Frishauf, Holtz, Goodman, Langer & Chick

[57] ABSTRACT

A silver halide photographic emulsion comprising silver halide grains which are prepared by a process comprising forming the silver halide grains in the presence of a dispersing medium and chemically sensitizing the silver halide grains formed, wherein, in the step of forming the silver halide grains, at least a part of the dispersing medium is a gelatin having an adenine content of 0.2 μg or less per g of gelatin and the silver halide grains are chemically sensitized in the presence of a compound represented by the following formula.

8 Claims, No Drawings

SILVER HALIDE EMULSION AND PROCESS FOR ITS PREPARATION

FIELD OF THE INVENTION

The present invention relates to a silver halide emulsion used in light-sensitive silver halide photographic materials. More particularly, it relates to a silver halide emulsion improved in sensitivity, fog and storage stability in a high-temperature and high-humidity environment, and a process for its preparation.

BACKGROUND OF THE INVENTION

In the field of light-sensitive silver halide color photographic materials, there is an increasing demand for those with a higher sensitivity, a lower fog and a higher image quality, with spread of ultrahigh-speed films as typified by ISO1600 to –3200 and small-formatted films as typified by disk films.

Moreover, in recent years, the demand for lens-attached films as typified by TORIKKIRI KONICA MINI (trade name; available from Konica Corporation) steadily increases because of their handy and inexpensive availability for taking photographs. With spread of the lens-attached films, there is a rapid increase in chances for taking photographs in tourist resorts especially in the summer season, and there are various conditions under which they are used. In particular, in many cases frequently seen, they are carried in a hot and humid environment as in cars and bags. Thus, it is urgently necessary to more improve storage stability of films in a high-temperature and high-humidity environment.

With regard to storage stability of silver halide emulsions, Japanese Patent Publication Open to Public Inspection (hereinafter referred to as Japanese Patent O.P.I. Publication) No. 24133/1991 discloses a technique in which a tyrosine content in gelatin is controlled to be 30 μmol/gelatin, Japanese Patent O.P.I. Publication 243943/1991 a technique which takes note of physical ripening restrainability of gelatin, and Japanese Patent O.P.I. Publication No. 171132/1991 a technique in which gelatin is extracted at a temperature of 38 to 65° C. in its production process.

Meanwhile, Japanese Patent O.P.I. Publication No. 23932/1982 discloses a technique in which adenine or its analogous compound is used at the time of Ostwald ripening of silver halide emulsions to improve sensitivity and fog of emulsions.

However, none of the techniques disclosed in these publications have reached a satisfactory level in respect of the storage stability in a high-temperature and high-humidity environment, and have been strongly sought to be more improved.

SUMMARY OF THE INVENTION

The present invention was made under such circumstances. An object thereof is to obtain a silver halide emulsion improved in its photographic performance, taking note of the gelatin used when silver halide emulsions are prepared.

Another object of the present invention is to obtain a silver halide emulsion that can provide a light-sensitive silver halide photographic material having a high sensitivity, a low fog density and a good storage stability in high-temperature and high-humidity environment.

The above objects of the present invention can be achieved by a silver halide emulsion which is prepared using as a dispersion medium a gelatin with an adenine content of not more than 0.2 μg per gram and has been chemically sensitized in the presence of a compound represented by the following Formula I.

Formula I

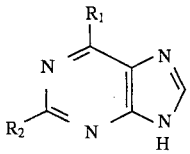

wherein $R_1$ and $R_2$ may be the same or different and each represent a hydrogen atom or a substituent; and a process for preparing a silver halide emulsion, comprising the steps of causing silver halide grains to grow using as a dispersion medium a gelatin with an adenine content of not more than 0.2 μg per gram, and adding at the time of chemical sensitization the compound represented by Formula I.

Namely, the present inventors have discovered that the photographic performance can be improved when a gelatin with a small adenine content is used as a dispersion medium at the time of the growth of silver halide grains and a specific compound is added at the time of chemical ripening.

DETAILED DESCRIPTION OF THE INVENTION

The constitution of the present invention will be described below in detail.

The adenine content in the gelatin according to the present invention can be measured by quantitative analysis on the basis of the adenine-guanine content as described in PAGI METHOD (Method for Testing Photographic Gelatin), Photographic and Gelatin Industries, Japan, 7th Edition (1992), Item 19, pages 29–30.

Thus, the gelatin is decomposed with sulfuric acid, then nucleic acid bases are precipitated as silver salts thereof and separated. The precipitate is dissolved with acid, then the amount of adenine is determined by liquid chromatography.

The gelatin with an adenine content of not more than 0.2 μg per gram can be obtained by the method described below.

With regard to the production of gelatin commonly available, reference may specifically be made to, e.g., SHASHIN KOGAKU-NO KISO, GIN-EN SHASHIN (Basic Photographic Engineering, Silver Salt Photography), Japan Photographic Society, Coronasha Co., pp.122–124.

Gelatin is produced from collagen, the main component of connective tissues of animals. Raw materials for photographic gelatin include cow bones, bovine hides and pig skin. It is common to use cow bones or hides. As methods of treating collagen, there are two types of methods, acid treatment and lime treatment. As photographic gelatin, it is common to employ the lime treatment. It is preferable also in the present invention to employ the lime treatment. As an example thereof, when photographic gelatin is produced from beef bones by lime treatment, it is usually produced by a process comprised of deliming, lime treatment, extraction, filtration, concentration, gelation and drying. For example, dried beef bones are immersed in a diluted hydrochloric acid solution for 4 to 8 days to effect deliming, followed by washing with water and neutralization, and then bovine skin or beef bones are immersed in saturated lime water for 2 to 3 months to remove kelatin and so forth, followed by washing with water and neutralization and then extraction (first extraction) for 6 to 8 hours in hot water of about 50 to 60° C. Thereafter, hot water of about 5 to 10° C. higher is added to carry out second and third extraction. After the extraction, a filtration step is followed, and the filtrate is concentrated under reduced pressure usually at a temperature of 60° C. or below, followed by cooling, gelation, and then drying at about 25° C. to finally obtain gelatin.

To produce the gelatin of the present invention, it is preferred to use beef hard bones as a raw material in the above production process. The gelatin can be obtained at an extraction temperature set at 60° C. or below and by deionization with both cation exchange resin and anion exchange resin after the step of filtration. The gelatin extraction temperature may preferably be 55° C. or below, and more preferably 40° C. or below.

The deionization may be carried out at any steps after the extraction of gelatin, and may preferably be carried out after the step of filtration.

The ion exchange resins include those of —H types and —Na types as cationic ion exchange groups, and those of —OH types and —Cl types as anionic ion exchange groups. Those of —H types are preferred as cationic ion exchange groups and those of —OH types as anionic ion exchange groups. As conditions for the treatment, the amount of ion exchange resins used and the treating time may preferably be set so that the treatment with ion exchange resins can be well carried out to remove all ionic components from a gelatin solution and the gelatin solution comes to have a pH value of approximately from 4.9 to 5.3. The treatment with the cationic ion exchange resin may preferably be made first.

The gelatin solution having been subjected to ion exchange treatment may be pH-adjusted using a usual pH adjustor, but may preferably be used as it is at the pH of the isoelectric point, without adjustment.

The adenine content in the gelatin of the present invention may preferably be not more than 0.1 μg, and more preferably be not more than 0.05 μg.

The adenine is present as a part of nucleic acid contained in gelatin, having a purine base structure. In the photographic industrial field, it is known as crystal habit modifier.

In the present invention, the preparation of silver halide grains refers to the course including the following steps;

1) the step of nucleus production to produce crystal nuclei of silver halide grains;
2) the step of seed grain formation to form seed grains of silver halide grains from the crystal nuclei; and
3) the step of growth to cause the seed grains to increase in size;

and up to a step prior to the step of desalting or desalinization. The gelatin of the present invention is used as a dispersion medium in at least one of the above steps, and a dispersion medium in the step 3) may preferably be comprised of the gelatin of the present invention. In the step 3), when a dispersion medium other than the gelatin of the present invention is used, the gelatin of the present invention must comprise at least 50% of the total weight of dispersion mediums used in the step 3).

The silver halide emulsion of the present invention may be formed of any of silver iodochloride, silver iodobromide and silver chloroiodobromide. In view of the advantage that especially high-sensitivity emulsions can be obtained, it may preferably be formed of silver iodobromide.

The silver halide emulsion prepared in the present invention may be either a polydisperse emulsion, having a broad grain size distribution, or a monodisperse emulsion, having a narrow grain size distribution, and may be used as a single emulsion or as a mixture of several kinds.

When light-sensitive materials are produced using the emulsion of the present invention, the emulsion may preferably be the monodisperse emulsion. A monodisperse emulsion with a particularly preferred dispersity is a monodisperse emulsion with a monodispersity of not more than 20%, and more preferably not more than 15%, as defined by the expression:

*(Standard deviation)/(average grain size)×100 (%)=monodispersity.*

Herein the average grain size r is defined to be grain size $r_i$ determined when $n_i \times r_i^3$ which is the product of frequency $n_i$ of grains having grain size $r_i$ and $r_i^3$ comes to be maximum. (Effective numeral is three figures, and minimum numeral is rounded off.) The grain size herein referred to is the diameter of a grain when it is spherical, or, in the case of other forms, a diameter obtained when a projected image of a grain is calculated as a circular image having the same area.

The monodisperse emulsion can be obtained by adding a water-soluble silver salt solution and a water-soluble halide solution in a gelatin solution containing seed grains, by double jet precipitation while controlling the pAg and pH. The rate of addition can be determined with reference to Japanese Patent O.P.I. Publications No. 48521/1979 and No. 49938/1983. The pAg at the time of crystal growth may preferably be 6 to 12. The pAg at the time of the formation of silver halide may be constant, or may be stepwise changed or continuously changed. When changed, it may preferably be raised with the formation of silver halide grains.

In the preparation of the silver halide emulsion of the present invention, stirring conditions at the time of preparation are important. It is preferable to use as a stirring device the device disclosed in Japanese Patent O.P.I. Publication No. 160128/1987 in which an aqueous silver salt solution and an aqueous halide solution are fed by double jet precipitation. The number of revolution in the stirring may preferably be 200 to 1,000 rpm.

In the preparation of the silver halide emulsion, known silver halide solvents such as ammonia, thioether and thiourea may also be used.

The substituents represented by $R_1$ and $R_2$ of the compound of Formula I can be arbitrarily selected. Preferably $R_1$ is an —$NH_2$ group and $R_2$ is a hydrogen atom, or $R_1$ is an —OH group and $R_2$ is a hydrogen atom or an —$NH_2$ group.

Typical examples of the compound used in the present invention are shown below, but are by no means limited to these.

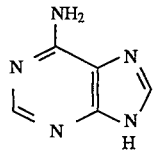

S-1

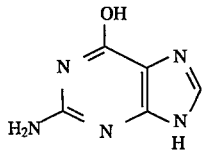

S-2

-continued

S-3

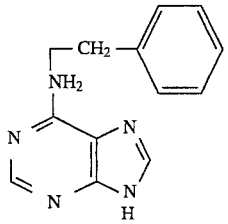

S-4

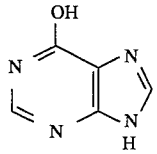

The compound of the present invention may be added at any time after the completion of desalinization and before the completion of chemical sensitization.

The compound of the present invention may preferably be added in an amount of from 0.1 to 100 mg/mol Ag, and more preferably from 0.1 to 100 mg/mol Ag.

The compound of the present invention may be added as it is in the form of a solid, or may preferably be added in the state of a solution. As a solvent therefor, it is preferable to use water or a lower alcohol solvent such as methanol. The compound of the present invention may be used alone or in combination of two or more kinds.

There are no particular limitations on silver halide emulsions to which the present invention is applied. For example, those disclosed in Research Disclosure No. 308119 (hereinafter "RD308119") can be used.

Items described and paragraphs thereof are shown below.

| Items | Page of RD308119 | |
|---|---|---|
| Iodide composition | 993 | Par. I-A |
| Preparation method | 993<br>994 | Par. I-A and<br>Par. E |
| Crystal habit: | | |
| Regular crystal | 993 | Par. I-A |
| Twinned crystal | 993 | Par. I-A |
| Epitaxial growth | 993 | Par. I-A |
| Halide composition: | | |
| Uniform | 993 | Par. I-B |
| Not uniform | 993 | Par. I-B |
| Halide conversion | 994 | Par. I-C |
| Halide substitution | 994 | Par. I-C |
| Metal occlusion | 994 | Par. I-D |
| Monodispersion | 995 | Par. I-F |
| Addition of solvent | 995 | Par. I-F |
| Latent image forming position: | | |
| Surface | 995 | Par. I-G |
| Interior | 995 | Par. I-G |
| Light-sensitive material used: | | |
| Negative | 995 | Par. I-H |
| Positive (containing internally fogged grains) | 995 | Par. I-H |
| Use of emulsion by mixture | 995 | Par. I-J |
| Desalting | 995 | Par. II-A |

The silver halide emulsion of the present invention is subjected to physical ripening, chemical ripening and spectral sensitization and then employed in light-sensitive materials. Additives used in such steps are described in Research Disclosures No. 17643, No. 18716 and No. 308119 (hereinafter "RD17643", "RD18716" and "RD308119", respectively).

Items described and paragraphs thereof are shown below.

| Items | Page of RD308119, RD17643, RD18716 | | | |
|---|---|---|---|---|
| Chemical sensitizer | 996 | Par. III-A | 23 | 648 |
| Spectral sensitizer | 996 | Par. IV-A-A,B,C,D,E-J | 23–24 | 648–649 |
| Supersensitizer | 996 | Par. IV-A-E,J | 23–24 | 648–649 |
| Antifoggant | 998 | Par. VI | 24–25 | 649 |
| Stabilizer | 998 | Par. VI | 24–25 | 649 |

Photographic additives usable in the present invention are also described in the above Research Disclosures. Items described and paragraphs thereof are shown below.

| Items | Page of RD308119, RD17643, RD18716 | | | |
|---|---|---|---|---|
| Color contamination preventive agent | 1002 | Par. VII-I | 25 | 650 |
| Color image stabilizer | 1001 | Par. VII-J | 25 | |
| Brightening agent | 998 | V | 24 | |
| Ultraviolet absorbent | 1003 | Par. VIIIC XIIIC | 25–26 | |
| Light absorbing agent | 1003 | Par. VIII | 25–26 | |
| Light scattering agent | 1003 | Par. VIII | | |
| Filter dye | 1003 | Par. VIII | 25–26 | |
| Binder | 1003 | Par. IX | 26 | 651 |
| Antistatic agent | 1006 | Par. XIII | 27 | 650 |
| Hardening agent | 1004 | Par. X | 26 | 651 |
| Plasticizer | 1006 | Par. XII | 27 | 650 |
| Lubricant | 1006 | Par. XII | 27 | 650 |
| Surfactant, coating aid | 1005 | Par. XI | 26–27 | 650 |
| Matting agent | 1007 | Par. XVI | | |
| Developing agent (contained in light-sensitive materials) | 1011 | Par. XXB | | |

Various couplers can be used in the light-sensitive material employing the emulsion of the present invention. Examples thereof are described in the above Research Disclosures. Related items described and paragraphs thereof are shown below.

| Items | Page of RD308119, RD17643 | | |
|---|---|---|---|
| Yellow coupler | 1001 | Par. VII-D | Par. VII-C–G |
| Magenta coupler | 1001 | Par. VII-D | Par. VII-C–G |
| Cyan coupler | 1001 | Par. VII-D | Par. VII-C–G |
| Colored coupler | 1002 | Par. VII-G | Par. VII-G |
| DIR coupler | 1001 | Par. VII-F | Par. VII-F |
| BAR coupler | 1002 | Par. VII-F | |
| Other useful residual group releasing coupler | 1001 | Par. VII-F | |
| Alkali-soluble coupler | 1001 | Par. VII-E | |

The additives used in the present invention can be added by the dispersion method as described in RD308119, Paragraph XIV.

In the light-sensitive material employing the emulsion of the present invention, the supports as described in the aforesaid RD17643, page 28, RD18716, pages 647 to 648 and RD308119, Paragraph XIX can be used.

The light-sensitive material employing the emulsion of the present invention may also be provided with the auxiliary layers such as filter layers and intermediate layers as described in RD308119, Paragraph VII-K.

The light-sensitive material employing the emulsion of the present invention may have various layer structure such as regular layer order, inverse layer order or unit structure as described in the aforesaid RD308119, Paragraph VII-K.

The silver halide emulsion of the present invention can be applied to various color light-sensitive materials as typified by color negative films for general purpose or motion pictures, color reversal films for slides or television, color paper, color positive films and color reversal paper.

The light-sensitive material employing the emulsion of the present invention may be photographically processed by conventional methods described in the aforesaid RD17643, page 28–29, RD18716, page 647 and RD308119, Paragraph XIX.

EXAMPLES

The present invention will be specifically described below by giving Examples. Embodiments of the present invention are by no means limited to these.

Example 1

Preparation of gelatins A and B:

Cow hard bones used as a raw material were immersed in a slaked lime suspension for 60 days, and then extracted at 50° C., followed by treatment with H-type cation exchange resin and further followed by treatment with OH-type anion exchange resin. Gelatin thus obtained was designated as A.

Under the same conditions for the preparation of gelatin A, was prepared gelatin B, provided that as raw materials was used a mixture of cow hard bones (55%) and soft bones (45%).

Preparation of gelatin C:

After extraction under the same conditions as gelatins A and B, treatment with only Na-type cation exchange resin was carried out to obtain gelatin C, provided that raw materials were the same as in gelatin B.

Preparation of gelatin D:

Cow bones used in gelatin B, as a raw material were treated in a slaked lime suspension for 60 days, and then extracted at 70° C., followed by treatment with H-type cation exchange resin and further followed by treatment with OH-type anion exchange resin. Gelatin thus obtained was designated as D.

Adenine content of the resulting gelatins A to D each was measured to obtain the results shown below.

| Gelatin | Extraction temperature (°C.) | Ion exchange treatment | Adenine content (μg/gelatin) | Remarks |
|---|---|---|---|---|
| A | 50 | H—OH | 0.02 | Inv. |
| B | 50 | H—OH | 0.10 | Inv. |
| C | 50 | Na | 0.30 | Comp. |
| D | 70 | H—OH | 0.25 | Comp. |

Preparation of seed emulsion T-1:

A seed emulsion comprising grains having parallel double twin planes were prepared.

| | |
|---|---|
| Solution A: | |
| Ossein gelatin | 80.0 g |
| Potassium bromide | 47.4 g |
| 20 wt. % methanol solution of $HO(CH_2CH_2O)_m(C(CH_3)HCH_2O)_{19.8}(CH_2CH_2O)_nH$ (m + n = 9.77) | 0.24 ml |
| Using distilled water, made up to 8,000.0 ml. | |
| Solution B: | |
| Silver nitrate | 1,200.0 g |
| Using distilled water, made up to 1,600.0 ml. | |
| Solution C: | |
| Ossein gelatin | 32.2 g |
| Potassium bromide | 790.0 g |
| Potassium iodide | 70.34 g |
| Using distilled water, made up to 1,600.0 ml. | |
| Solution D: | |
| Ammonium water | 470.0 ml |

To solution A vigorously stirred at 40° C., solutions B and C were added by double jet precipitation over a period of 7.7 minutes to carry out formation of nuclei. In this course, the pBr was maintained at 1.60. Thereafter, the temperature was dropped to 20° C. over a period of 30 minutes. Solution D was further added in 1 minute, and subsequently ripening was carried out for 5 minutes. At the time of the ripening, potassium bromide was in a concentration of 0.03 mol/liter, and ammonia, in a concentration of 0.66 mol/liter.

After the ripening was completed, the pH was adjusted to 6.0, followed by desalinization according to a conventional method. To the emulsion having been desalinized, 10% by weight of aqueous gelatin solution was added, and the mixture was dispersed with stirring at 60° C. for 30 minutes, followed by addition of distilled water so as to be made up to 5,360 g of an emulsion.

The resulting seed emulsion grains were observed on an electron microscope to reveal that they were spherical grains having double twin planes parallel to each other, contained in a percentage of 75% in number ratio with respect to the whole particles, and having an average grain size of 0.217 μm.

Preparation of emulsion Em-1 of the present invention:

Using seven kinds of solutions shown below, tabular monodisperse emulsion Em-1 having parallel double twin planes according to the present invention was prepared.

| | |
|---|---|
| Solution A | |
| Gelatin A | 67.0 g |
| Distilled water | 3,176.0 ml |
| 20 wt. % methanol solution of $HO(CH_2CH_2O)_m(C(CH_3)HCH_2O)_{19.8}(CH_2CH_2O)_nH$ (m + n = 9.77) | 1.25 ml |
| Seed emulsion T-1 | 98.51 g |
| Using distilled water, made up to 3,500 ml. | |
| Solution B | |
| Aqueous 0.5N silver nitrate solution | 948.0 ml |
| Solution C | |
| Potassium bromide | 52.88 g |
| Gelatin A | 35.55 g |
| Using distilled water, made up to 948 ml. | |
| Solution D | |
| Aqueous 3.5N silver nitrate solution | 4,471.0 ml |
| Solution E | |
| Potassium bromide | 1,862.2 g |
| Gelatin A | 200 g |
| Using distilled water, made up to 447 ml. | |
| Solution F | |
| Fine-grain emulsion* comprised of 3 wt. % gelatin A and silver iodide grains (average grain size: 0.05 μm) | |

*prepared in the following way.

To 5,000 ml of a 0.6 wt. % gelatin solution containing 0.06 mol of potassium iodide, 2,000 ml of aqueous solutions each containing 7.06 mol of silver nitrate and 7.06 mol of potassium iodide were added over a period of 10 minutes. The pH in the course of the formation of fine grains was controlled to be 2.0 using nitric acid, and the temperature, 40° C. After the formation of grains, the pH was adjusted to 6.0 using an aqueous sodium carbonate solution. The emulsion was made up in a weight of 12.53 kg.

Solution G

Aqueous 1.75N potassium bromide solution

Solution A was added in a reaction vessel, and, while vigorously stirring, solutions B to F were added by double jet precipitation according to the combination as shown in Table 1, to grow the seed crystals. Thus, a core/shell type silver halide emulsion was prepared.

Here, (1) the solutions B, C and F, (2) the solutions D, E and F and (3) the solutions D and E were added by accelerated flow rate precipitation, the flow rate being so changed with respect to time as to accord with the critical growth rate, and were added at a suitable rate of addition so as not to become polydisperse because of generation of small grains other than the growing seed crystals and because of Ostwald ripening.

In the course of crystal growth, the solution temperature inside the reaction vessel was kept at 75° C. and the pAg was controlled to be 8.8 by optionally adding the solution G.

Grain size and silver iodide content in the silver halide phase on the surface, at the time of points with respect to the reaction solution addition time are shown together in Table 1.

TABLE 1

| Solutions added | Solution addition time (min) | Grain size (μm) | Silver iodide content (mol %) |
|---|---|---|---|
| (1) B, C, F | 0.00 | 0.217 | 6.0 |
| | 12.50 | 0.318 | 8.4 |
| | 22.83 | 0.370 | 10.8 |
| | 30.98 | 0.410 | 13.2 |
| (2) D, E, F | 30.99 | 0.410 | 13.2 |
| | 52.82 | 0.499 | 20.4 |
| | 76.69 | 0.584 | 30.0 |
| | 122.33 | 0.715 | 30.0 |
| | 150.56 | 0.780 | 30.0 |
| | 155.12 | 0.790 | 27.5 |
| | 176.38 | 0.836 | 15.1 |
| | 187.90 | 0.860 | 7.7 |
| (3) D, E | 188.00 | 0.862 | 0.0 |
| | 210.46 | 0.959 | 0.0 |
| | 224.92 | 1.062 | 0.0 |
| | 233.55 | 1.133 | 0.0 |
| | 243.00 | 1.230 | 0.0 |

After the growth of grains, desalinization was carried out by the method as disclosed in Japanese Patent Application No. 41314/1991, followed by addition of gelatin to carry out redispersion, and the pH and pAg were adjusted to 5.80 and 8.06, respectively, at 40° C. From a scanning electron microscope photograph of the resulting emulsion grains, it was ascertained that the emulsion was a tabular grain emulsion having an average grain size of 1.23 μm, an average aspect ratio of 2.0 and a coefficient of variation of grain size distribution, of 14.0%.

Preparation of emulsion Em-2:

Emulsion Em-2 was prepared in the same manner as in emulsion Em-1 except that the gelatin A was replaced with gelatin B. From a scanning electron microscope photograph of the resulting emulsion grains, it was ascertained that the emulsion was a tabular grain emulsion having an average grain size of 1.27 μm, an average aspect ratio of 2.1 and a coefficient of variation of grain size distribution, of 14.2%.

Preparation of emulsion Em-3:

Emulsion Em-3 was prepared in the same manner as in emulsion Em-1 except that the gelatin A was replaced with gelatin C. From a scanning electron microscope photograph of the resulting emulsion grains, it was ascertained that the emulsion was a tabular grain emulsion having an average grain size of 1.23 μm, an average aspect ratio of 2.3 and a coefficient of variation of grain size distribution, of 15.7%.

Preparation of emulsion Em-4:

Emulsion Em-4 was prepared in the same manner as in emulsion Em-1 except that the gelatin A was replaced with gelatin D. From a scanning electron microscope photograph of the resulting emulsion grains, it was ascertained that the emulsion was a tabular grain emulsion having an average grain size of 1.24 μm, an average aspect ratio of 3.0 and a coefficient of variation of grain size distribution, of 22.3%.

Example 2

The silver halide emulsions Em-1 to Em-4 were optimally gold-sulfur sensitized (chemical sensitization). Using these emulsions, multi-layer color photographic light-sensitive materials comprising a triacetyl cellulose film support and provided thereon the layers composed as shown below were produced in which these Em-1 to Em-4 were each used in the fifth layer (a high-speed red-sensitive layer). At the time of the chemical sensitization of the emulsions Em-1 to Em-4, the kind, addition time and amount of the compound of the present invention were changed, as shown in Table. The chemical sensitization was carried out at 50° C.

In the following, the coating weights are each indicated as a weight expressed in units of g/m$^2$ in terms of metallic silver in respect of silver halides and colloidal silver, a weight expressed in units of g/m$^2$ in respect of couplers and additives, and, in respect of sensitizers, a weight represented by molar number per mol of silver halide contained in the same layer.

Structure of multi-layer color photographic light-sensitive material, Sample 101, employing Em-1:

First layer: Anti-halation layer

| | |
|---|---|
| Black colloidal silver | 0.16 |
| Ultraviolet absorbent UV-1 | 0.20 |
| High-boiling solvent OIL-1 | 0.16 |
| Gelatin | 1.60 |

Second layer: Intermediate layer

| | |
|---|---|
| Compound SC-1 | 0.14 |
| High-boiling solvent OIL-2 | 0.17 |
| Gelatin | 0.80 |

Third layer: Low-speed red-sensitive layer

| | |
|---|---|
| Silver iodobromide emulsion A | 0.15 |
| Silver iodobromide emulsion B | 0.35 |
| Spectral sensitizer SD-1 | $2.0 \times 10^{-4}$ |
| Spectral sensitizer SD-2 | $1.4 \times 10^{-4}$ |
| Spectral sensitizer SD-3 | $1.4 \times 10^{-5}$ |
| Spectral sensitizer SD-4 | $0.7 \times 10^{-4}$ |
| Cyan coupler C-1 | 0.53 |
| Colored cyan coupler CC-1 | 0.04 |
| DIR compound D-1 | 0.025 |
| High-boiling solvent OIL-3 | 0.48 |
| Gelatin | 1.09 |

Fourth layer: Medium-speed red-sensitive layer

| | |
|---|---|
| Silver iodobromide emulsion B | 0.30 |
| Silver iodobromide emulsion C | 0.34 |

-continued

| | |
|---|---|
| Spectral sensitizer SD-1 | $1.7 \times 10^{-4}$ |
| Spectral sensitizer SD-2 | $0.86 \times 10^{-4}$ |
| Spectral sensitizer SD-3 | $1.15 \times 10^{-5}$ |
| Spectral sensitizer SD-4 | $0.86 \times 10^{-4}$ |
| Cyan coupler C-1 | 0.33 |
| Colored cyan coupler CC-1 | 0.013 |
| DIR compound D-1 | 0.02 |
| High-boiling solvent OIL-1 | 0.16 |
| Gelatin | 0.79 |

Fifth layer: High-speed red-sensitive layer

| | |
|---|---|
| Emulsion Em-1 | 0.95 |
| Spectral sensitizer SD-1 | $1.0 \times 10^{-4}$ |
| Spectral sensitizer SD-2 | $1.0 \times 10^{-4}$ |
| Spectral sensitizer SD-3 | $1.2 \times 10^{-5}$ |
| Cyan coupler C-2 | 0.14 |
| Colored cyan coupler CC-1 | 0.016 |
| High-boiling solvent OIL-1 | 0.16 |
| Gelatin | 0.79 |

Sixth layer: Intermediate layer

| | |
|---|---|
| Compound SC-1 | 0.09 |
| High-boiling solvent OIL-2 | 0.11 |
| Gelatin | 0.80 |

Seventh layer: Low-speed green-sensitive layer

| | |
|---|---|
| Silver iodobromide emulsion A | 0.12 |
| Silver iodobromide emulsion B | 0.38 |
| Spectral sensitizer SD-4 | $4.6 \times 10^{-5}$ |
| Spectral sensitizer SD-5 | $4.1 \times 10^{-4}$ |
| Magenta coupler M-1 | 0.14 |
| Magenta coupler M-2 | 0.14 |
| Colored magenta coupler CM-1 | 0.06 |
| High-boiling solvent OIL-4 | 0.34 |
| Gelatin | 0.70 |

Eighth layer: Intermediate layer

| | |
|---|---|
| Gelatin | 0.41 |

Ninth layer: Medium-speed green-sensitive layer

| | |
|---|---|
| Silver iodobromide emulsion B | 0.30 |
| Silver iodobromide emulsion C | 0.34 |
| Spectral sensitizer SD-6 | $1.2 \times 10^{-4}$ |
| Spectral sensitizer SD-7 | $1.2 \times 10^{-4}$ |
| Spectral sensitizer SD-8 | $1.2 \times 10^{-4}$ |
| Magenta coupler M-1 | 0.04 |
| Magenta coupler M-2 | 0.04 |
| Colored magenta coupler CM-1 | 0.017 |
| DIR compound D-2 | 0.025 |
| DIR compound D-3 | 0.002 |
| High-boiling solvent OIL-4 | 0.12 |
| Gelatin | 0.50 |

Tenth layer: High-speed green-sensitive layer

| | |
|---|---|
| Silver iodobromide emulsion D | 0.95 |
| Spectral sensitizer SD-6 | $7.1 \times 10^{-5}$ |
| Spectral sensitizer SD-7 | $7.1 \times 10^{-5}$ |
| Spectral sensitizer SD-8 | $7.1 \times 10^{-5}$ |
| Magenta coupler M-1 | 0.09 |
| Colored magenta coupler CM-1 | 0.011 |
| High-boiling solvent OIL-4 | 0.11 |
| Gelatin | 0.79 |

Eleventh layer: Yellow filter layer

| | |
|---|---|
| Yellow colloidal silver | 0.08 |
| Compound SC-1 | 0.15 |
| High-boiling solvent OIL-2 | 0.19 |
| Gelatin | 1.10 |

Twelfth layer: Low-speed blue-sensitive layer

| | |
|---|---|
| Silver iodobromide emulsion A | 0.12 |
| Silver iodobromide emulsion B | 0.24 |
| Silver iodobromide emulsion C | 0.12 |
| Spectral sensitizer SD-9 | $6.3 \times 10^{-5}$ |
| Spectral sensitizer SD-10 | $1.0 \times 10^{-5}$ |
| Yellow coupler Y-1 | 0.50 |
| Yellow coupler Y-2 | 0.50 |
| DIR compound D-4 | 0.04 |
| DIR compound D-5 | 0.02 |
| High-boiling solvent OIL-2 | 0.42 |
| Gelatin | 1.40 |

Thirteenth layer: High-speed blue-sensitive layer

| | |
|---|---|
| Silver iodobromide emulsion C | 0.15 |
| Silver iodobromide emulsion E | 0.80 |
| Spectral sensitizer SD-9 | $8.0 \times 10^{-5}$ |
| Spectral sensitizer SD-11 | $3.1 \times 10^{-5}$ |
| Yellow coupler Y-1 | 0.12 |
| High-boiling solvent OIL-2 | 0.05 |
| Gelatin | 0.79 |

Fourteenth layer: First protective layer

| | |
|---|---|
| Silver iodobromide emulsion (average grain size: 0.08 μm; silver iodide content: 1.0 mol %) | 0.40 |
| Ultraviolet absorbent UV-1 | 0.065 |
| High-boiling solvent OIL-1 | 0.07 |
| High-boiling solvent OIL-3 | 0.07 |
| Gelatin | 0.65 |

Fifteenth layer: First protective layer

| | |
|---|---|
| Alkali-soluble matting agent (average particle diameter: 2 μm) | 0.15 |
| Polymethyl methacrylate (average particle diameter: 3 μm) | 0.04 |
| Lubricant WAX-1 | 0.04 |
| Gelatin | 0.55 |

In addition to the foregoing composition, coating aid Su-1, dispersion aid Su-2, viscosity modifiers, hardening agents H-1 and H-2, stabilizer ST-1, antifoggants AF-1 and two kinds of AF-2 with an average molecular weight of 10,000 and an average molecular weight of 1,100,000, and antiseptic DI-1 were added.

The emulsions used in the above sample are as follows. In the following, the average grain size is indicated as grain diameter calculated in that of a cube. The respective emulsions have been subjected to gold-sulfur sensitization to an optimum.

| Emulsion | Average AgI content (mol %) | Average grain size (μm) | Crystal habit | Diameter/ thickness ratio |
|---|---|---|---|---|
| A | 4.0 | 0.30 | Regular | 1 |
| B | 6.0 | 0.42 | Regular | 1 |

-continued

| Emulsion | Average AgI content (mol %) | Average grain size (μm) | Crystal habit | Diameter/ thickness ratio |
|---|---|---|---|---|
| C | 6.0 | 0.55 | Regular | 1 |
| D | 6.0 | 0.85 | Twinned tabular | 4 |
| E | 6.0 | 0.95 | Twinned tabular | 4 |

In preparing the samples, the first to eighth layers were provided by simultaneous coating at the first, and the ninth to fifteenth layers were provided thereon by simultaneous coating at the second, using a multi-slide hopper type coater. Structures of the compounds used in the preparation of the above samples are shown below.

C-1

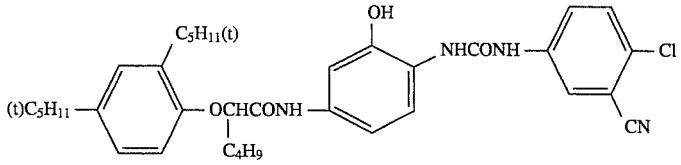

C-2

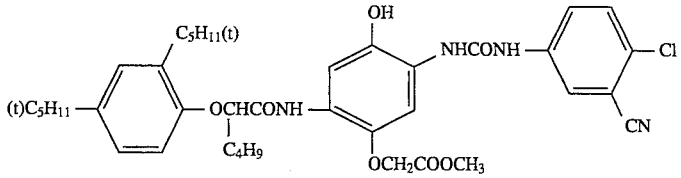

M-1

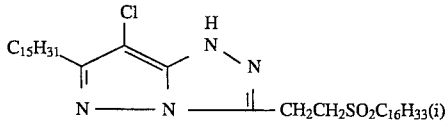

M-2

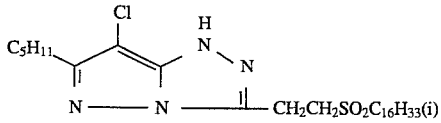

Y-1

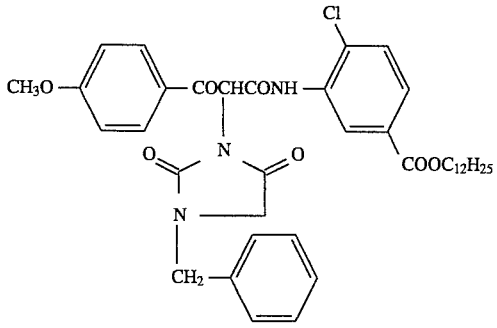

Y-2

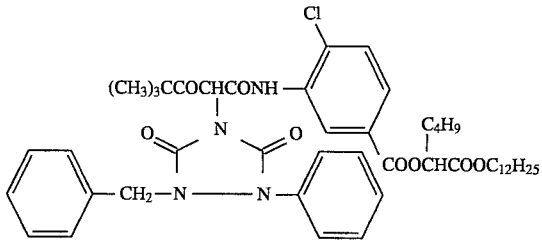

-continued
CC-1
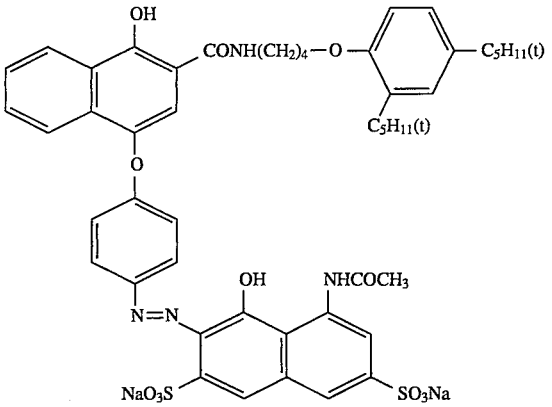
CM-1
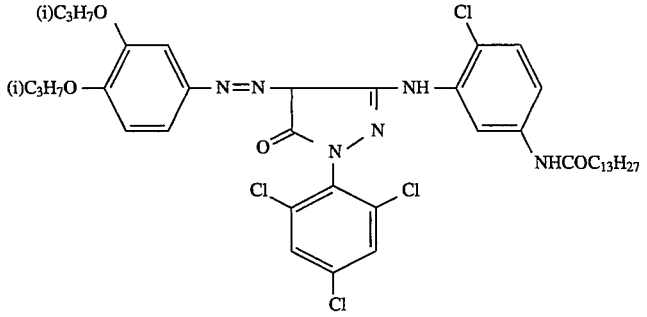
D-1
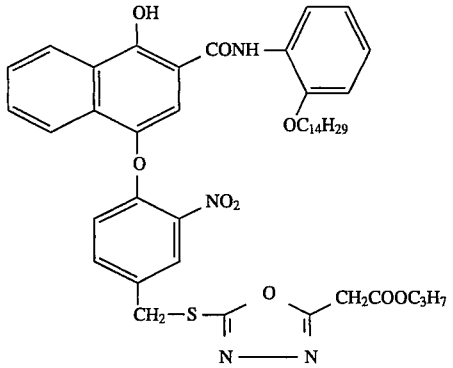
D-2
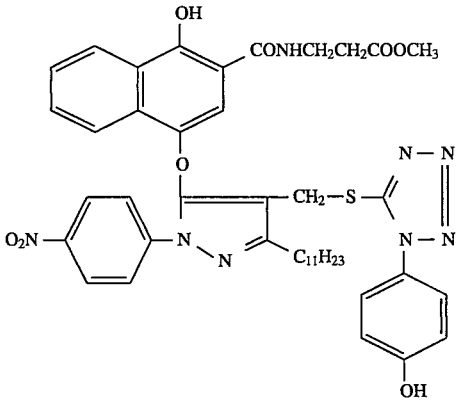

-continued
D-3
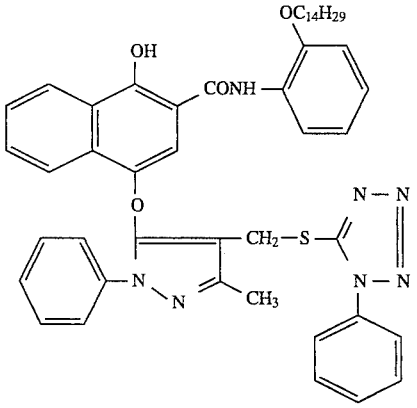
D-4
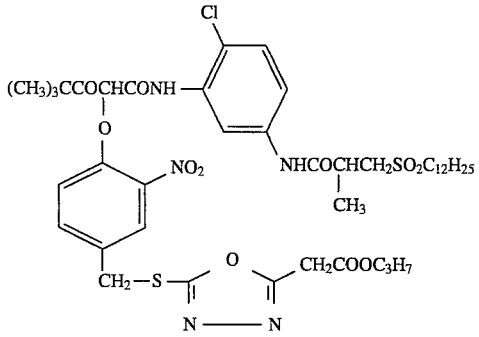
D-5
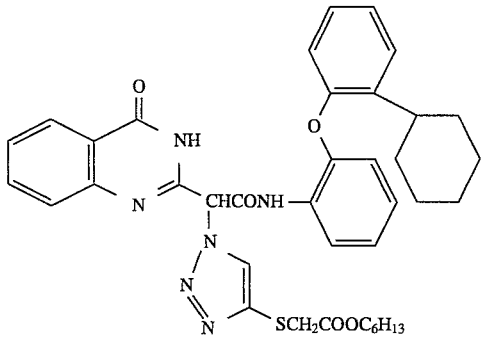
OIL-1
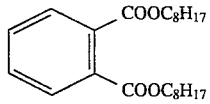
OIL-2
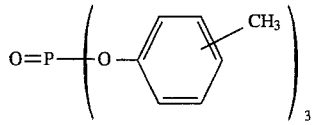
OIL-3
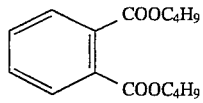
OIL-4
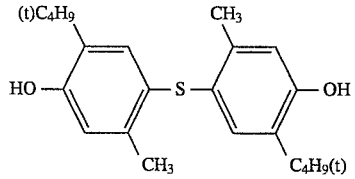

-continued
SC-1
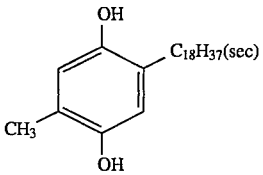
UV-1
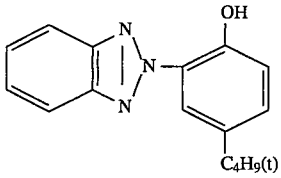
WAX-1
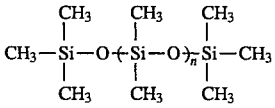
Weight average molecular weight Mw: 3,000
Su-1
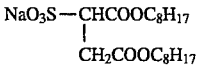
Su-2
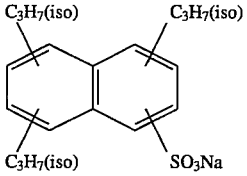
SD-1
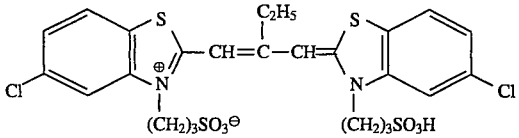
SD-2
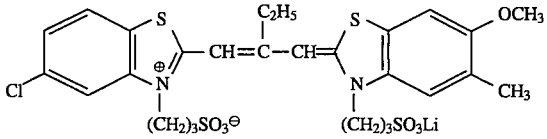
SD-3
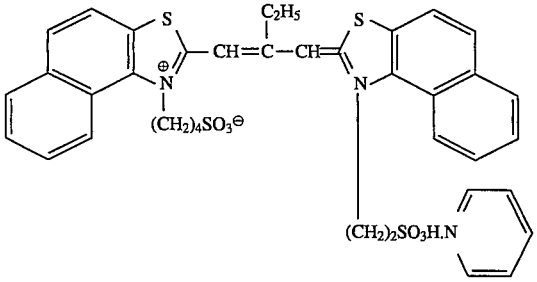
SD-4
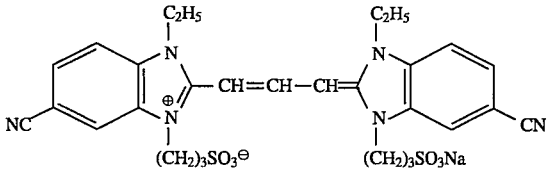
SD-5
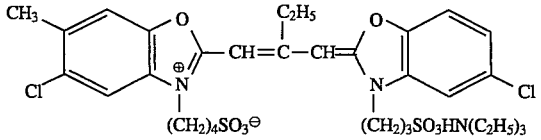

-continued
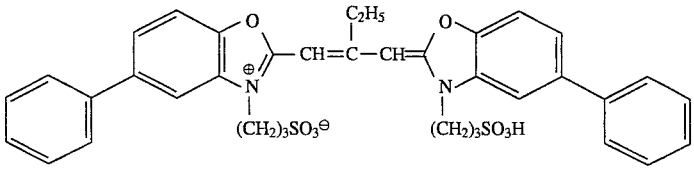
SD-6
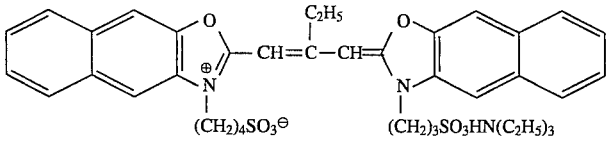
SD-7
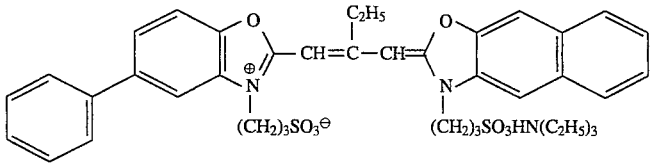
SD-8
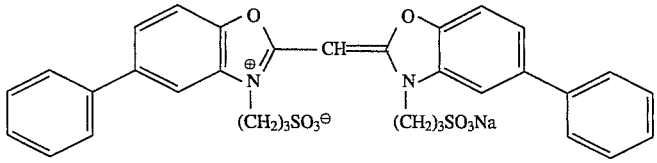
SD-9
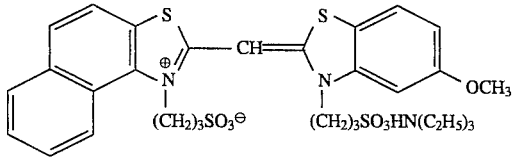
SD-10
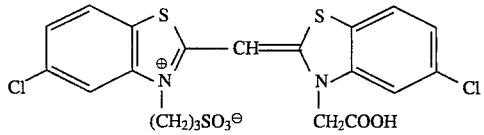
SD-11
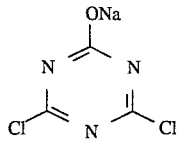
H-1
$(CH_2{=}CHSO_2CH_2)_2O$
H-2
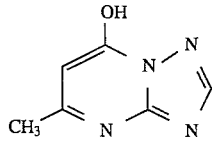
ST-1
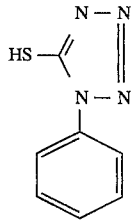
AF-1

-continued

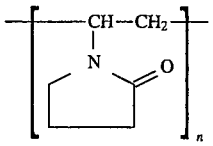

n: degree of polymerization

Compound DI-1 (a mixture of the following three components)

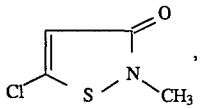

(Component A)

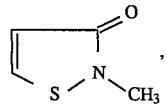

(Component B)

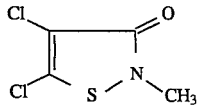

(Component C)

The samples thus obtained were subjected to wedge exposure for sensitometry (1/200") using red light. Within 1 minute after the exposure, the samples were photographically processed according to the following processing steps, and a reciprocal of the amount of exposure for providing a density of +0.15 of minimum density ($D_{min}$) was determined, where, assuming the sensitivity of sample 101 as 100, its relative value was regarded as immediate sensitivity (the larger the value is with respect to 100, the higher the sensitivity is) and the absolute value of the minimum density ($D_{min}$) of each sample as immediate fog, which were as shown in Table 3.

| Processing step | Processing time | Processing temperature |
|---|---|---|
| 1. Color developing | 3 min. 15 sec. | 38.0 ± 0.1° C. |
| 2. Bleaching | 6 min. 30 sec. | 38.0 ± 3.0° C. |
| 3. Washing | 3 min. 15 sec. | 24–41° C. |
| 4. Fixing | 6 min. 30 sec. | 38.0 ± 3.0° C. |
| 5. Washing | 3 min. 15 sec. | 24–41° C. |
| 6. Stabilizing | 3 min. 15 sec. | 38.0 ± 3.0° C. |
| 7. Drying | | 50° C. or below |

Processing solutions used in the respective steps were composed as shown below.

| Color developing solution | |
|---|---|
| 4-Amino-3-methyl-N-ethyl-N-(β-hydroxyethyl) aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Made up to 1 liter by adding water, and adjusted to pH 10.1. | |
| **Bleaching solution** | |
| Ferric ammonium ethylenediaminetetraacetate | 100.0 g |
| Diammonium ethylenediaminetetraacetate | 10.0 g |
| Ammonium bromide | 150.0 g |
| Glacial acetic acid | 10.0 g |
| Made up to 1 liter by adding water, and adjusted to pH 6.0 using ammonia water. | |
| **Fixing solution** | |
| Ammonium thiosulfate | 175.0 g |
| Anhydrous sodium sulfite | 8.5 g |
| Sodium metabisulfite | 2.3 g |
| Made up to 1 liter by adding water, and adjusted to pH 6.0 using acetic acid. | |
| **Stabilizing solution** | |
| Formalin (aqueous 37% solution) | 1.5 ml |
| KONIDAKS (trade name; available from Konica Corporation) | 7.5 ml |
| Made up to 1 liter by adding water. | |

Evaluation of storage stability:

Samples 101 to 115 were left to stand in an environment of temperature 60° C. and relative humidity 80% for a week. Thereafter, each sample was subjected to wedge exposure for sensitometry (1/200") using red light, and the sensitivity and fog after the photographic processing were also determined to obtain the results as shown together in Table 3. In all instances, the smaller the change from the immediate value is, the stabler the performance during storage is.

TABLE 3 (A)

| Sample No. | Emulsion | Compound of the invention: Type | Time of addition | Amount (mg/mol Ag) |
|---|---|---|---|---|
| 101 | Em-1 (Y) | S-1 | a* | 3.0 |
| 102 | Em-1 (") | " | b** | " |
| 103 | Em-2 (") | " | a* | " |
| 104 | Em-2 (") | " | b** | " |
| 105 | Em-3 (X) | S-1 | a* | " |
| 106 | Em-4 (") | S-2 | b** | " |
| 107 | Em-1 (Y) | S-2 | a* | " |
| 108 | Em-1 (") | " | b** | " |
| 109 | Em-2 (") | " | a* | " |
| 110 | Em-2 (") | " | b** | " |
| 111 | Em-1 (") each | S-1 | a* | 1.5 |
| 112 | Em-2 (") | S-1 | b** | " |
| 113 | Em-1 (X) | None | — | — |
| 114 | Em-2 (") | " | — | — |
| 115 | Em-4 (") | None | — | — |

X: Comparative Example
Y: Present Invention
*: The compound was added at five minutes before the start of chemical sensitization.
**: The compound was added at five minutes after the start of chemical sensitization.

TABLE 3 (B)

| Sample No. | Immediate relative sensitivity | Immediate relative fog | After storage relative sensitivity | After storage relative fog |
|---|---|---|---|---|
| 101 (Y) | 100 | 0.03 | 99 | 0.04 |
| 102 (") | 98 | 0.04 | 95 | 0.06 |
| 103 (") | 96 | 0.04 | 95 | 0.05 |

TABLE 3 (B)-continued

| Sample No. | Immediate relative sensitivity | Immediate relative fog | After storage relative sensitivity | After storage relative fog |
|---|---|---|---|---|
| 104 (") | 96 | 0.05 | 93 | 0.08 |
| 105 (X) | 72 | 0.08 | 65 | 0.12 |
| 106 (") | 66 | 0.09 | 59 | 0.14 |
| 107 (Y) | 99 | 0.04 | 93 | 0.06 |
| 108 (") | 98 | 0.05 | 90 | 0.08 |
| 109 (") | 96 | 0.05 | 90 | 0.08 |
| 110 (") | 96 | 0.06 | 87 | 0.10 |
| 111 (") | 98 | 0.03 | 96 | 0.04 |
| 112 (") | 96 | 0.04 | 95 | 0.05 |
| 113 (X) | 93 | 0.05 | 59 | 0.23 |
| 114 (") | 90 | 0.06 | 55 | 0.25 |
| 115 (") | 66 | 0.09 | 38 | 0.26 |

X: Comparative Example
Y: Present Invention

As is clear from the results shown in Table 3, the samples employing the emulsions Em-1 and Em-2 making use of the gelatin of the present invention show especially good immediate base paper and low fog, and the use of the compound S-1 or S-2 of the present invention brings about an improvement in the stability of sensitivity and fog after storage.

What is claimed is:

1. A silver halide photographic emulsion comprising silver halide grains which are prepared by a process comprising (i) forming the silver halide grains in the presence of a gelatin and (ii) chemically sensitizing the silver halide grains formed, wherein, in forming the silver halide grains of (i), said gelatin has an adenine content of 0.2 μg or less per g of gelatin and in (ii), chemical sensitization is carried out in the presence of a compound represented by the following formula (I), and wherein said silver halide grains are silver iodobromide, silver iodochlorobromide or silver iodochloride, formula (I)

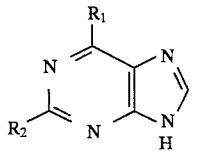

wherein $R_1$ and $R_2$ independently represent a hydrogen atom or a substituent.

2. The silver halide emulsion of claim 1, wherein the adenine content of the gelatin is 0.1 μg or less per g of gelatin.

3. The silver halide emulsion of claim 1, wherein the amount of the compound is 0.1 to 100 mg/mol Ag.

4. The silver halide emulsion of claim 1, wherein in formula, $R_1$ is an amino group and $R_2$ is a hydrogen atom; or $R_1$ is a hydroxy group and $R_2$ is a hydrogen atom or an amino group.

5. The silver halide emulsion of claim 4, wherein the compound is added to the emulsion at a time after completing desalting and prior to the start of chemical sensitization.

6. A method of preparing a silver halide emulsion comprising silver halide grains and a gelatin comprising the steps of (i) forming silver halide seed grains, (ii) causing the seed grains to increase in size to form a silver halide emulsion, (iii) subjecting the silver halide emulsion thus formed to desalting to remove soluble salts and (iv) chemically sensitizing the silver halide emulsion desalted, wherein in step (ii) the silver halide emulsion is formed in the presence of a gelatin having an adenine content of 0.2 μg or less per g of gelatin; and in the step (iv), the silver halide emulsion is chemically sensitized in the presence of a compound represented by the following formula (I), and wherein said silver halide emulsion comprises silver iodobromide grains, silver iodochlorobromide grains or silver iodochloride grains, formula (I)

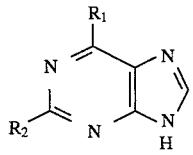

wherein $R_1$ and $R_2$ independently represent a hydrogen atom or a substituent.

7. The method of claim 6, wherein the compound is added to the emulsion at a time after completing desalting and prior to the completion of chemical sensitization.

8. The method of claim 7, wherein the compound is added to the emulsion in an amount of 0.1 to 100 mg/mol Ag.

* * * * *